US005542800A

United States Patent [19]

Detterman et al.

[11] Patent Number: 5,542,800

[45] Date of Patent: Aug. 6, 1996

[54] METHOD AND SYSTEM FOR BINDING A PACK OF SIGNATURES

[75] Inventors: Don E. Detterman, Willard; Robert W. Erwin, Bucyrus, both of Ohio

[73] Assignee: R. R. Donnelley & Sons Company, Chicago, Ill.

[21] Appl. No.: 415,294

[22] Filed: Apr. 3, 1995

[51] Int. Cl.[6] ..... B42C 9/00

[52] U.S. Cl. ..... 412/8; 412/1; 412/37

[58] Field of Search ..... 412/1, 6, 8, 9, 412/29, 30, 37, 901

[56] References Cited

U.S. PATENT DOCUMENTS

| | | | |
|---|---|---|---|
| 2,895,148 | 7/1959 | Hildman | 412/30 X |
| 3,413,669 | 12/1968 | Thorp | 412/30 X |
| 4,408,780 | 10/1983 | Detterman et al. | 281/15.1 |
| 5,295,775 | 3/1994 | Andjelic et al. | 412/8 X |
| 5,417,535 | 5/1995 | Andjelic et al. | 412/8 X |

*Primary Examiner*—Willmon Fridie, Jr.
*Attorney, Agent, or Firm*—Arnold, White & Durkee

[57] ABSTRACT

A method of binding a pack of signatures, at least some of said signatures including a plurality of interleaved sheets and each of said signatures having a closed side, comprises the following steps. The pack of signatures is clamped with the closed sides of the signatures lowermost and coplanar with one another along a spine of the pack. The closed lowermost sides of the signatures are sawed to expose the interleaved sheets of the signatures. The sawed lowermost sides of the signatures are slashed with a multiplicity of cuts lateral to the lengths of the sawed lowermost sides. A preparatory adhesive is applied to the sawed lowermost sides of the signatures to create an initial bond of the interleaved sheets of the signatures. The preparatory adhesive is cured until it is substantially free of surface moisture. After applying and curing the preparatory adhesive, a notcher forms a multiplicity of closely spaced, wide open notches in the lowermost sides of the signatures. After forming the notches in the lowermost sides of the signatures, a spine coat adhesive and a side coat adhesive are applied to the notched lowermost sides of the signatures. Finally, the spine coat adhesive and the side coat adhesive are cured until they are substantially set. The application of adhesive before, as well as after, the step of forming the multiplicity of notches in the lowermost sides of the signatures significantly enhances the binding strength of the pack.

14 Claims, 6 Drawing Sheets

METHOD AND SYSTEM FOR BINDING A PACK OF SIGNATURES

FIELD OF THE INVENTION

The present invention relates to techniques for binding packs of signatures and, more particularly, relates to a method and system for binding the pack of signatures so that it has improved binding strength.

BACKGROUND OF THE INVENTION

Perfect binding is very popular because it is much faster and less expensive than side sewing or spine sewing, and it can be used to manufacture books which are too thick for saddle stitching. However, conventional perfect binding has the disadvantage that the pages are not held at the spine with the strength of sewn books. This, therefore, limits the categories of books to which perfect binding may be applied. Trade books and text books are a special category due to the expectations that they employ high quality, low opacity paper, requiring paper stock with low fiber content and heavy coatings. Adhesive binding of the such books becomes extremely difficult due to the requirement that these books must withstand rough handling and other abuses. Publishers of such books have generally considered it necessary to have them sewn for strength. This, however, adds greatly to the cost of such books and correspondingly limits the market for them.

Accordingly, a need has existed for many years for a method of binding books which is capable of producing books comparable in binding strength to books with sewn bindings but at the cost of perfect binding. The need, of course, has become more acute as both the cost of book manufacturing increases and level of competition in the publishing industry increases which requires stronger bindings at a lower cost. Moreover, a need exists for a method of binding books which is capable of binding both books of ordinary thickness as well as books having thicknesses as great as 4" (10.2 cm).

SUMMARY OF THE INVENTION

In one particular embodiment of the present invention, a pack of signatures is first formed with at least some of the signatures including a plurality of interleaved sheets and each of the signatures having a closed side. Next, the pack of signatures is clamped with the closed sides of the signatures lowermost and coplanar with one another along a spine of the pack. Then, the closed lowermost sides of the signatures are sawed to expose the interleaved sheets of the signatures. Next, the sawed lowermost sides of the signatures are slashed with a multiplicity of cuts lateral to the lengths of the sawed lowermost sides. Then, a preparatory adhesive is applied to the sawed lowermost sides of the signatures to create an initial bond of the interleaved sheets of the signatures. Next, the preparatory adhesive is cured until it is substantially free of moisture. After applying and curing the preparatory adhesive, a notcher forms a multiplicity of closely spaced, wide open notches in the lowermost sides of the signatures. After forming the notches in the lowermost sides of the signatures, a spine coat adhesive and a side coat adhesive are applied to the notched lowermost sides of the signatures. Finally, the spine coat adhesive and the side coat adhesive are cured until they are substantially set. The application of adhesive before, as well as after, the step of forming-the multiplicity of notches in the lowermost sides of the signatures enhances the binding strength of the pack.

DESCRIPTION OF THE PREFERRED EMBODIMENT

Figure 1C:
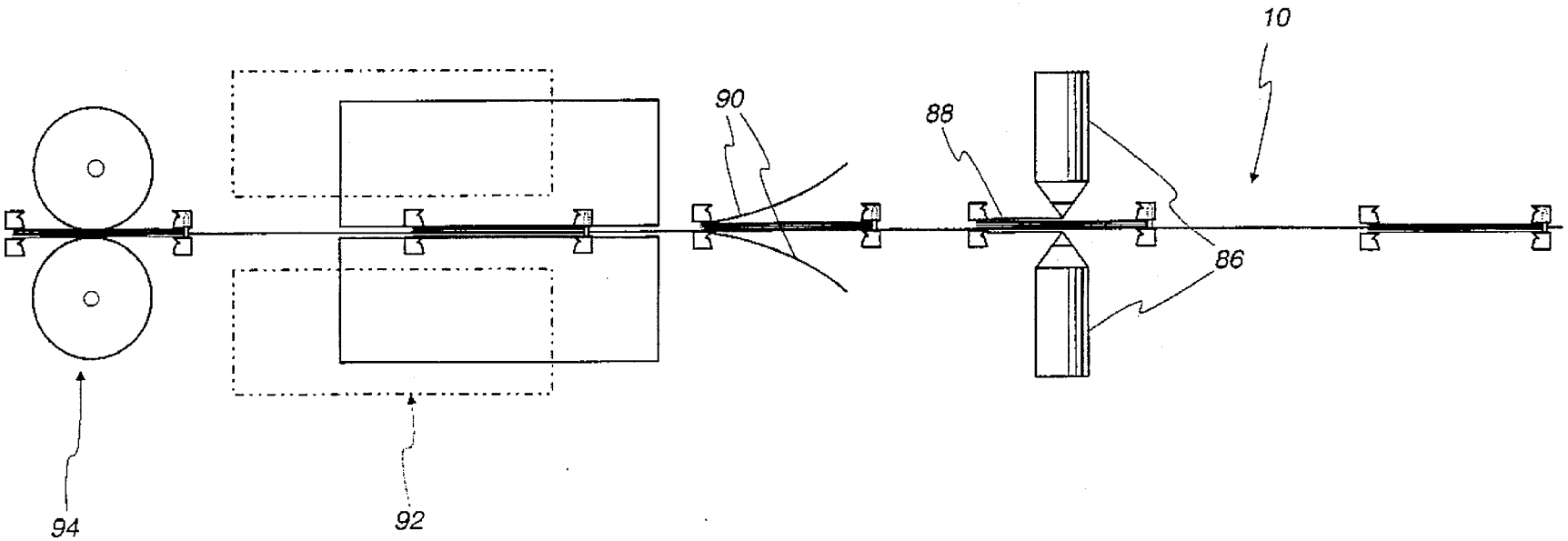
FIGS. 1*a–c* are diagrammatic top views illustrating the several steps in the high speed, continuous process of making a bound pack of signatures in accordance with the present invention.
Figure 1:
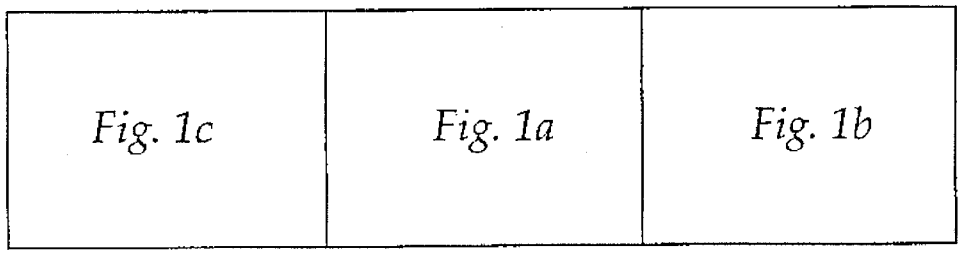
Figure 1A:
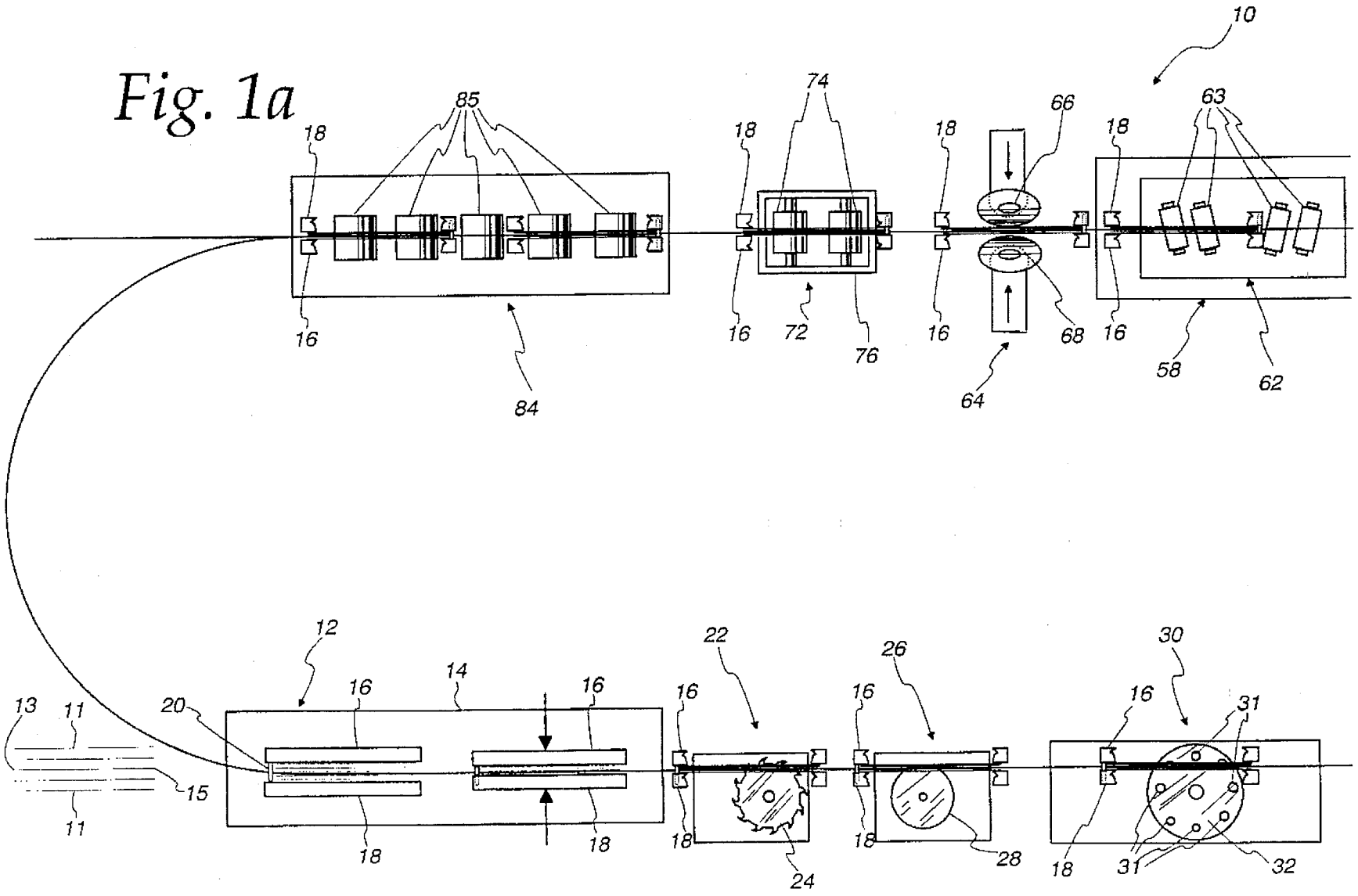
Figure 1B:
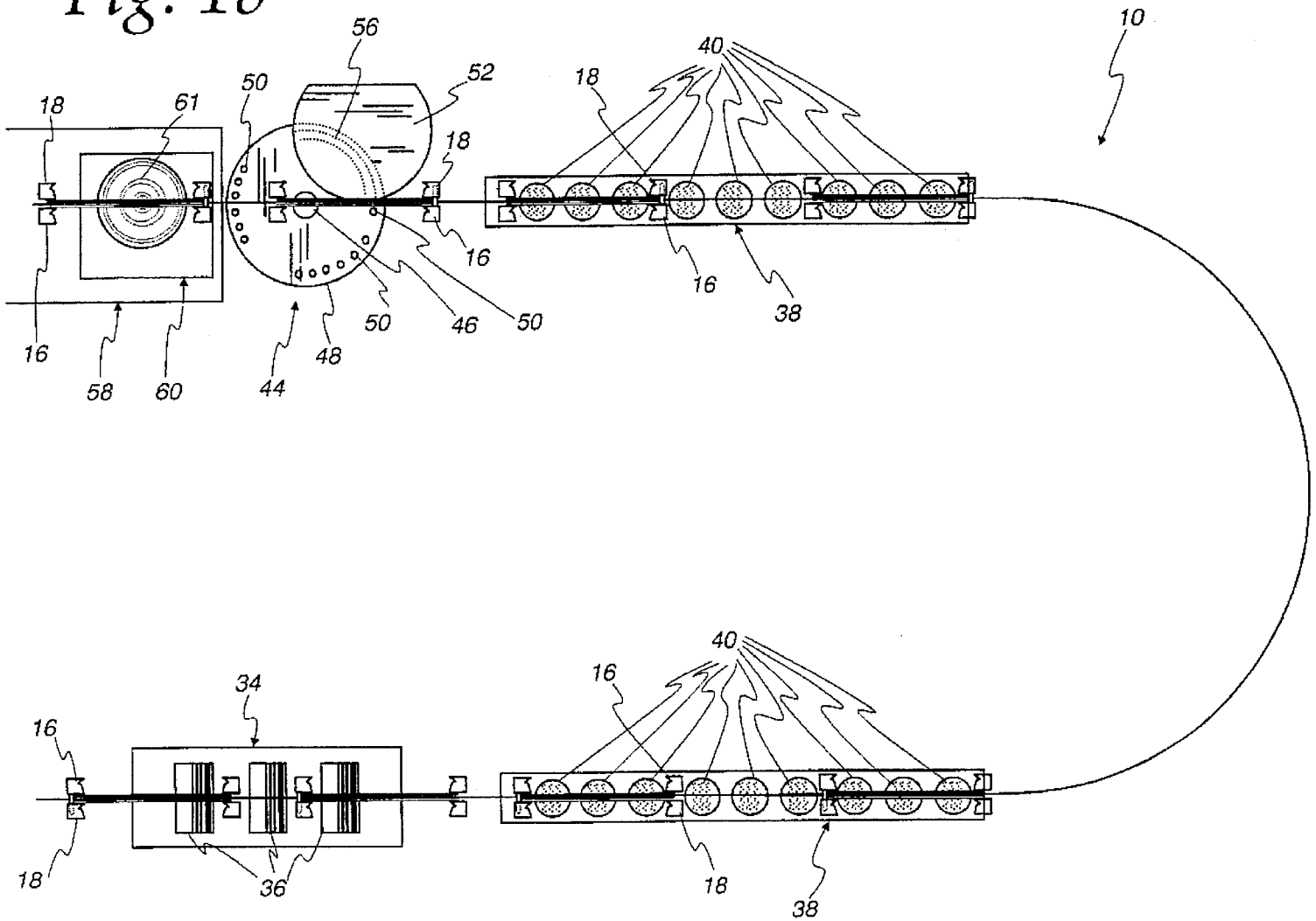

FIGS. 1*a–c* illustrate a perfect binding system 10 embodying the present invention. The perfect binding system 10 includes a plurality of stations used to bind a pack of signatures entering the system 10. The pack of signatures is carried by clamps through the plurality of stations which comprise the perfect binding system 10. Each of these stations is described in detail below. In connection with the description of these stations, reference should be made to FIGS. 1*a–c* illustrating a top view of the entire perfect binding system 10 and FIGS. 2*a* through 16*b* illustrating end views and side views of a pack of signatures successively moving through the plurality of stations making up the system 10.

Figure 2A:
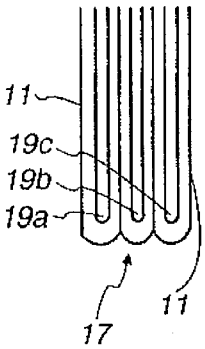
FIG. 2*a* is an end view of a loose pack of signatures before they enter the binding process in FIGS. 1*a–c;*
Figure 2B:
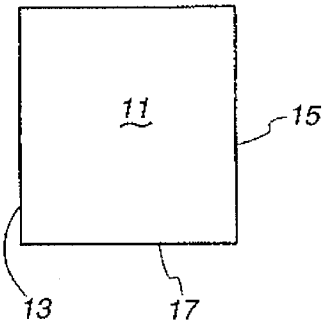
FIG. 2*b* is a side view of the loose pack of signatures in FIG. 2*a;*

Referring to FIGS. 2*a* and 2*b*, the signatures first are stacked so that they can be assembled into a pack having opposing faces 11, a leading end 13, a trailing end 15, and a spine 17. This pack may contain any desired number of signatures. For the sake of simplicity, the pack is illustrated in FIG. 2*a* as consisting of three signatures 19*a*, 19*b*, and 19*c* which have respective closed sides along the spine 17 of the pack. Just as the pack may consist of any desired number of signatures, each signature may consist of any desired number of pages. Once again for the sake of simplicity, each signature is illustrated in FIG. 2*a* as consisting of two sheets, i.e., four pages. FIG. 2*b* is a side view of the loose pack of signatures.

Figure 3A:
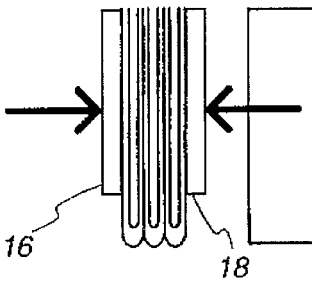
FIG. 3*a* is an end view of the loose pack of signatures in the process of being clamped at a clamping station.
Figure 3B:
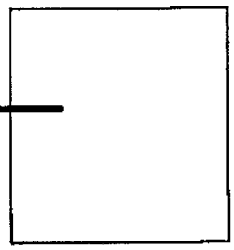
FIG. 3*b* is a side view of the loose pack of signatures in the process of being clamped at the clamping station.
Figure 4A:
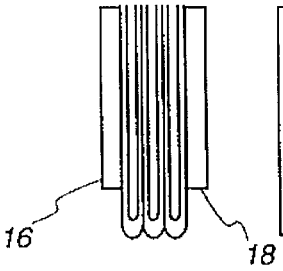
FIG. 4*a* is an end view of the clamped pack of signatures at a sawing station.

After being stacked into a pack, the pack of signatures enter a conventional clamping station 12, where the signatures are both leveled and clamped. The pack first is placed on a leveling table 14. Due to gravity, the signatures are forced downward with their closed sides at the bottom abutting the leveling table 14. At this point, clamps 16 and 18 are loose and the pack of signatures is pushed along by pins 20 mounted to the trailing ends of the clamps. The pins 20 bear upon the trailing end 13 of the pack of signatures. The pack is then clamped by the two clamps 16 and 18, one on each side (FIGS. 3*a–b*). The clamps 16 and 18 grip the pack in an area above the spine 17 of the pack so that the closed sides of the signatures can be sawed and milled without interference from the clamps 16 and 18. FIG. 4*a* depicts the pack of signatures after it has been clamped by the clamps 16 and 18 at the clamping station 12.

Figure 4B:
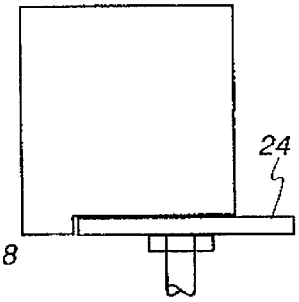
FIG. 4*b* is a side view of the pack of signatures in the process of passing through the sawing station.

From the clamping station 12, the clamps 16 and 18 carry the pack to a conventional sawing station 22 (FIGS. 4*a–b*). At the sawing station 22, a circular saw blade 24 rotates such that as the pack proceeds across it, the closed sides of the signatures are cut off. Typically, the depth of the cut is between about 1/16" and about 3/16" inches (4.763 mm) and is such that it exposes the interleaved sheets of the signatures.

Figure 5A:
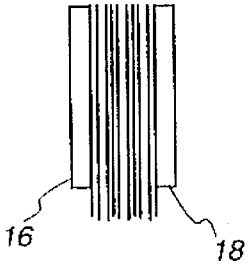
FIG. 5*a* is an end view of the sawed pack of signatures at a milling station.
Figure 5B:
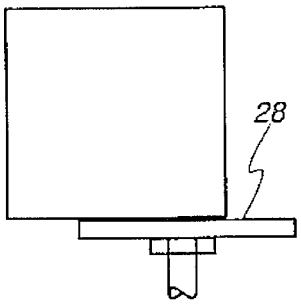
FIG. 5*b* is a side view of the sawed pack of signatures in the process of passing through the milling station.

After the pack has been sawed at the sawing station 22, the pack then proceeds to a conventional milling station 26 where lower edges of the exposed interleaved sheets of the signatures are milled (FIGS. 5*a–b*). The milling station 26 employs a conventional rougher driven by a motor which is separate from the main drive of the system 10. The motor drives a rotating blade 28 which sands the exposed, jagged lower edges of the signatures to create a smooth surface along the spine of the pack.

Figure 6A:
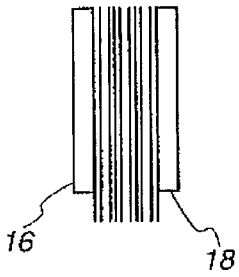
FIG. 6*a* is an end view of the milled pack of signatures at a slashing station.
Figure 6B:
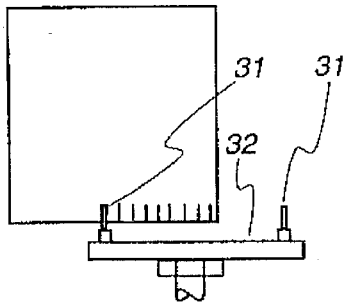
FIG. 6*b* is a side view of the milled pack of signatures in the process of passing through the slashing station.
Figure 6C:
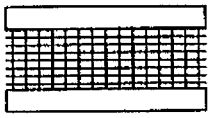
FIG. 6*c* is a bottom view of the pack of signatures after passing through the slashing station.

From the milling station 26, the pack proceeds to a slashing station 30 (FIGS. 6*a–b*). Preferably, the slashing station 30 uses a circular fixture 32 containing a plurality of sharp "V" shaped cutting blades 31. As shown in FIG. 6*b*, the cutting blades 31 slash the milled spine 17 of the pack in a direction lateral to the length of the spine 17. FIG. 6*c* is a bottom view of the pack of signatures showing the lateral cuts formed in the spine 17 by the cutting blades 31. These lateral cuts provide additional surface area for capturing adhesive later applied to the spine 17, mechanically bind the sheets of the signatures together, aid in controlling the depth of adhesive penetration, and provide a tip line for the enhancement of the binding. The lateral cuts can vary in depth but are typically between about 0.010" and 0.020" (0.254 mm to 0.508 mm) deep into the spine 17 of the pack.

Figure 7A:
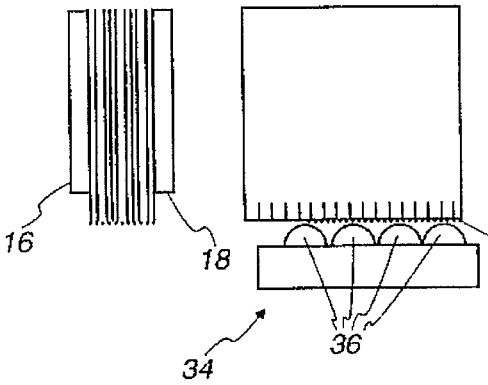
FIG. 7*a* is an end view of the slashed pack of signatures at an emulsion adhesive application station.
Figure 7B:
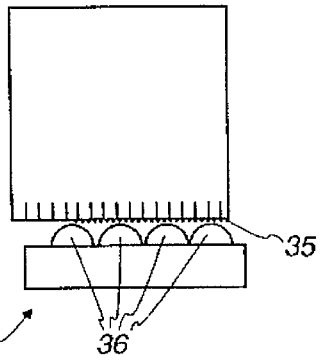
FIG. 7*b* is a side view of the slashed pack of signatures in the process of passing through the emulsion adhesive application station.
Figure 8A:
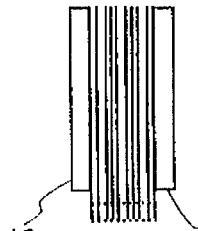
FIG. 8*a* is an end view of the pack of signatures at a first curing station.
Figure 8B:
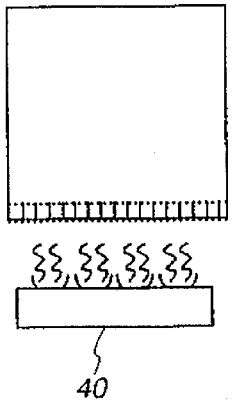
FIG. 8*b* is a side view of the pack of signatures in the process of passing through the first curing station.
Figure 9A:
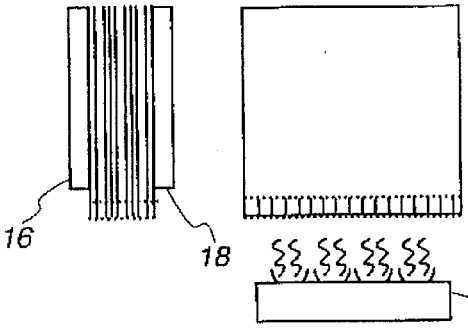
FIG. 9*a* is an end view of the partially cured pack of signatures at a second curing station.
Figure 9B:
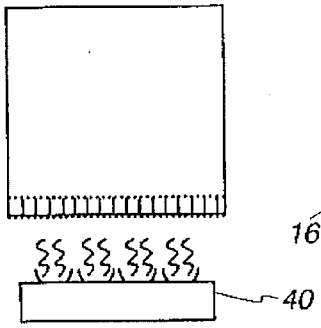
FIG. 9*b* is a side view of the partially cured pack of signatures in the process of passing through the second curing station.

After the pack has been laterally slashed, the clamps 16 and 18 convey the pack of signatures to an emulsion adhesive application station 34 where an emulsion adhesive 35 is applied to provide an initial bond of the lower edges of the interleaved sheets of signatures along the spine 17 of the pack (FIGS. 7*a–b*). Although the adhesive 35 is preferably an emulsion adhesive such as residual vinyl acetate, the adhesive 35 may alternatively be any suitable "cold" adhesive. The adhesive 35 is preferably applied by a series of rollers 36. The lateral cuts imparted at the slashing station 30 allow both the lower edges and faces of the interleaved signature sheets to be adhered instead of only the lower edges. Adhering both the lower edges and the presented faces of the interleaved signature sheets provides a basis for additional binding strength absent from other perfect binding techniques.

Next, the clamps 16 and 18 carry the pack of signatures through a pair of conventional curing stations 38 (FIGS. 8*a–b* and 9*a–b*). Each of these curing stations 38 includes a set of dryers 40 which dry the emulsion adhesive 35 along the lower edges and faces of the interleaved signature sheets. The dried adhesive is substantially free of surface moisture such that the adhesive is dry to the touch but somewhat moist beneath its surface. The curing stations 38 may be implemented with Wonder Glo dryers procurable from Glenro Inc. of Paterson, N.J.

Figure 10A:
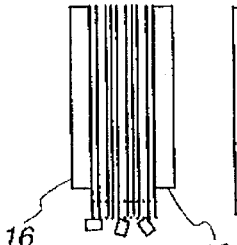
FIG. 10*a* is an end view of the cured pack of signatures at a notching station.
Figure 10B:
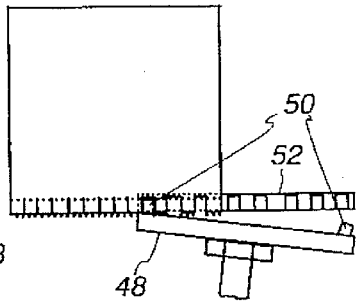
FIG. 10*b* is a side view of the cured pack of signatures in the process of passing through the notching station.

After exiting the pair of curing stations 38, the pack of signatures enters a notching station 44 (FIGS. 10*a–b*). The notching station 44 preferably consists of a notching machine which has a shaft 46 like a conventional roughing cutter of a perfect binding machine. The shaft 46 is oriented at a small angle to the vertical. Fixed on the upper end of the shaft 46 is a notcher plate 48 provided with three sets of three notching blades 50 extending upward from the plate 48. The sets of notching blades 50 are evenly spaced around the periphery of the plate 48. Behind the notcher plate 48 is a fixed backup plate 52 which is circular and has a tangent area 54 in contact with the back surface of the signature pack immediately below the clamps 16 and 18. The notching blades 50 run in an arcuate slot 56 formed in the bottom surface of the backup plate 52, so the entire lower marginal portion of the signature pack is supported immediately adjacent the notching blades 50. Conveniently, the backup plate 52 is fabricated from relatively soft metal, such as cold finished Muntz metal, or from a phenolic resin and vegetable fibre material, so the arcuate slot 56 may be cut in the backup plate by the notching blades 50 themselves before the notching station is put into operation. The small acute angle of the shaft 46 to the vertical is just enough that the sets of notching blades 50 at the downstream side of the plate 48 clear the the pack.

In the present system 10, the rate of rotation of the shaft 46 is precisely coordinated with the speed at which the clamps 16 and 18 travel, since it is the downstream travel of the pack coordinated with the space between the sets of notching blades 50 that produces the multiplicity of spaced notches in the spine 17 of the pack. Any conventional type of slave control may be used to coordinate the rate of rotation of the notcher shaft 46 with the speed of the binding machine drive.

The notches are formed by the cutting blades 50 and the cutting of the notches tends to cause at least a small amount of fiber binding of the cut sheets which is secured at the second adhesive application described below. Adhering the interlocking fibers and the additional spine length created by the notch faces in the spine generates additional binding strength. At the same time, the notches have very clean, straight faces. The sharpness of the cutting blades 50 preferably varies in accordance with the type of paper forming the signatures. Sharper (narrower) cutting blades are generally used with less heavily coated paper due to the tendency of such paper to tear unevenly. Conversely, wider cutting blades are generally used with more heavily coated paper due to the tendency of such paper to tear smoothly. With such variations in the sharpness of the cutting blades 50, the width of the notches may be anywhere between about 1/32" and 5/32" (1.6 to 4 mm). The depth of the notches is sufficient that they penetrate a considerable distance from the lowermost edge of the spine 17 of the signature pack. Typically, the depth may be anywhere between about 0.025" and 0.050" (0.635 to 1.270 mm). The notches are usually spaced 3/8" apart (9.525 mm) as measured from notch center to notch center.

Figure 11A:
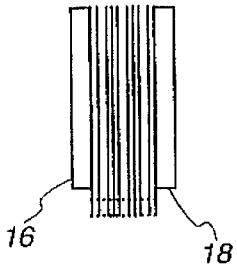
FIG. 11*a* is an end view of the notched pack of signatures at a cup brushing segment of a brushing station.
Figure 11B:
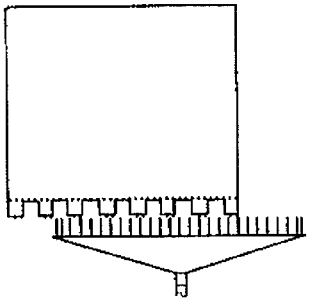
FIG. 11*b* is a side view of the notched pack of signatures in the process of passing through the cup brushing segment of the brushing station.
Figure 12A:
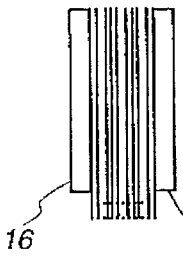
FIG. 12*a* is an end view of the partially brushed pack of signatures at an angle brushing segment of the brushing station.
Figure 12B:
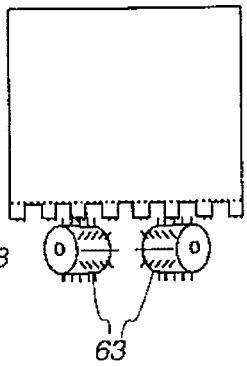
FIG. 12*b* is a side view of the partially brushed pack of signatures in the process of passing through the angle brushing segment of the brushing station.

After the notching station 44, the pack preferably proceeds to a conventional brushing station 58 (FIGS. 11*a–b* and 12*a–b*). Though not absolutely necessary, brushing off loose pieces of the binding and other debris helps establish a clean surface for application of subsequent adhesive and consequently provides for a stronger binding. Preferably, the brushing station 58 includes two brushing segments 60 and 62. As shown in FIG. 11*b*, a cup brush 61 at the brushing segment 60 rotates in a circular direction as the pack is moved across it. Then, as shown in FIG. 12*b*, the pack proceeds across angled brushes 63 at the brushing segment 62. The brushes 63 are mounted at varied angles to the pack transport path for removing further debris. The angled positions of the brushes 63 helps to remove loose material that was missed by the circular brush 61.

Figure 13A:
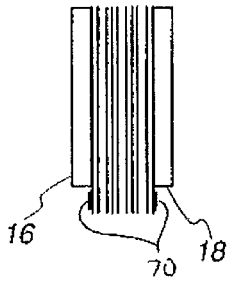
FIG. 13*a* is an end view of the brushed pack of signatures at a side coat adhesive application station.
Figure 13B:
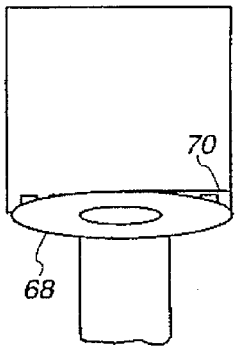
FIG. 13*b* is a side view of the brushed pack of signatures in the process of passing through the side coat adhesive application station.

The clamps 16 and 18 next carry the pack of signatures to a side coat application station 64 (FIGS. 13*a–b*). This side coat application station 64 applies a side bead of hot melt adhesive 70 along the opposing faces 11 of the pack in the area of the notches. When the side bead of adhesive 70 is applied, some of the adhesive extends into the notches along their horizontal and vertical edges (as viewed in FIG. 13*b*) so as to dose the these edges of the notches. The application of adhesive is accomplished by using two wheels 66 and 68 which are angled with respect to the vertical.

Figure 14A:
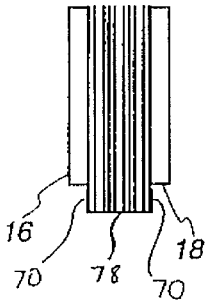
FIG. 14*a* is an end view of the side-coated pack of signatures at a spine coat adhesive application station.
Figure 14B:
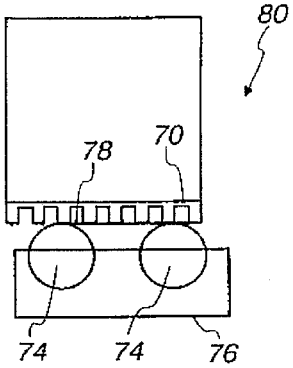
FIG. 14*b* is a side view of the side-coated pack of signatures in the process of passing through the spine coat adhesive application station.
Figure 15A:
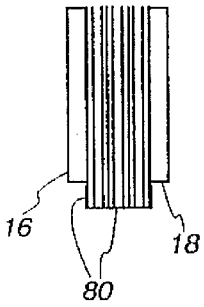
FIG. 15*a* is an end view of the spine-coated pack of signatures at a third curing station.

After exiting the side coat application station 64, the pack enters a spine coat application station 72 of entirely conventional construction (FIGS. 14*a–b*). The spine coat application station 72 includes a hot melt adhesive tank 76 and one or more driven rollers 74 which are wide enough to apply excess hot melt adhesive to the entire spine 17 of the pack, thus forming a thick spine coat 78 which amalgamates with the thin side bead 70 to provide a homogeneous finished wrap-around coating 80 (FIG. 15*a*). The rollers 74 apply the spine coat 78 to the entire spine area, including the faces of the notches, the areas of the spine between the notches, and to a line somewhat above the top faces of the notches. The spine coat applicator 72 also includes a conventional spinner (not shown) which removes excess hot melt adhesive from the spine coat 78 and returns it to the tank 76. The removal of excess hot melt adhesive allows the back surface of the finished wrap-around coating 80 (FIG. 15*a*) to be smooth and of uniform thickness.

As stated above, both the side bead of adhesive 70 and spine coat of adhesive 78 are preferably composed of a hot melt adhesive. This hot melt adhesive may be a standard commercial formulation of a type that is available from various suppliers. Typically, such an adhesive consists of ethylene vinyl acetate, a resin ester, or a hydrocarbon resin, and a microcrystalline wax or petroleum wax. One such adhesive is Fuller's #1538, procurable from H. B. Fuller Co. of St. Paul, Minn.

Figure 15B:
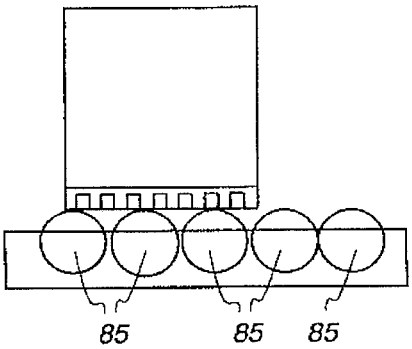
FIG. 15*b* is a side view of the spine-coated pack of signatures in the process of passing through the third curing station.

Next, the clamps 16 and 18 convey the pack of signatures to a conventional curing station 84 (FIGS. 15*a–b*). The curing station 84 preferably contains a series of cooling wheels 85 which cool the hot melt adhesive previously applied at the side coat applicator 64 and the spine coat applicator 72 until the hot melt adhesive is substantially set.

Figure 16A:
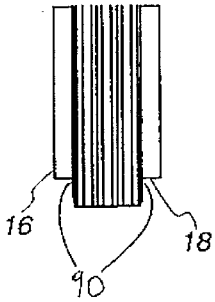
FIG. 16*a* is an end view of the cured pack of signatures after passing through the third curing station and an endsheet attachment station.
Figure 16B:
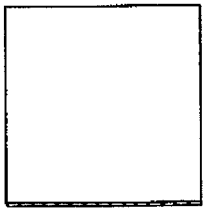
FIG. 16*b* is a side view of the pack of signatures after attaching a pair of endsheets thereto.

Endsheets can be attached to the opposing faces 11 of the pack of signatures in one of two ways. In one embodiment, as disclosed in U.S. Pat. No. 4,408,780 to Detterman et al., the endsheets are attached at the beginning of the binding process. In the preferred embodiment, as illustrated in FIG. 1*c*, the endsheets are attached at the end of the binding process after passing through the curing station 84. Specifically, the pack of signatures first passes through a tip line applicator 86 which applies thin strips of adhesive 88 along the lower edges of respective opposing faces 11 of the pack. The endsheets 90 are attached to the opposing faces 11 of the pack along the thin strips of adhesive 88. The pack of signatures passes through a conventional nipper 92 which applies pressure to secure the endsheets 90 to the pack. Finally, the pack proceeds through conventional rub down wheels 94. FIGS. 16*a* and 16*b* depict the pack of signatures following the attachment of the endsheets 90.

If the bound pack of signatures is to be covered, the tip line applicator 86 is bypassed and endsheets are not attached to the pack of signatures. Instead, conventional cover application equipment is used to apply a cover after which the signature pack is delivered from the binders as a bound, covered book.

Further information concerning various stations in the system 10, including the clamping station 12, the notching station 44, the side coat applicator 64, and the spine coat applicator 72, may be obtained from U.S. Pat. No. 4,408,780 to Detterman et al., entitled "BOUND BOOK AND METHOD OF MAKING SUCH BOOKS", issued Oct. 11, 1983, and incorporated herein by reference.

The perfect binding system 10 is able to bind loose packs of signatures at a rate in excess of about 100 packs per minute. The cost of binding packs of signatures in accordance with the system 10 is directly comparable to the cost of conventional perfect binding. At this economical cost, tests have found that the perfect binding system 10 produces bound packs of signatures having a thirty percent greater binding strength than bound signature packs manufactured using conventional perfect binding techniques. Moreover, the perfect binding system 10 may be used to bind packs which are thicker than packs bound using conventional perfect binding techniques. The packs employed with the perfect binding system 10 may have a thickness as great as 4" (10.2 cm).

What is claimed is:

1. A method of binding a pack of signatures, at least some of said signatures including a plurality of interleaved sheets and each of said signatures having a closed side, said method comprising the steps of:

clamping the pack of signatures with said closed sides of said signatures lowermost and generally coplanar with one another along a spine of the pack;

sawing the spine of the pack to expose the interleaved sheets of the signatures;

slashing the spine of the pack with a multiplicity of cuts lateral to the length of the spine of the pack;

applying a preparatory adhesive to the sawed spine of the pack to create an initial bond of the interleaved sheets of the signatures;

curing said preparatory adhesive until said preparatory adhesive is substantially free of surface moisture;

after curing said preparatory adhesive, forming a multiplicity of closely spaced, wide open notches in the spine of the pack;

after forming said notches, applying a spine coat of adhesive to the spine of the pack;

after forming said notches, applying a side coat of adhesive to lower marginal portions of opposing faces of the pack to close edges of said notches; and curing said spine coat of adhesive and said side coat of adhesive until said spine coat of adhesive and said side coat of adhesive are substantially set.

2. The method of claim 1 further including a step of brushing off any loose particles from the spine of the pack after said step of forming a multiplicity of notches.

3. The method of claim 1 wherein said spine coat of adhesive is a hot melt adhesive.

4. The method of claim 3 wherein said side coat of adhesive is a hot melt adhesive.

5. The method of claim 1 wherein said preparatory adhesive is an emulsion adhesive.

6. The method of claim 1 further including a step of attaching endsheets to the pack after said step of curing said spine coat of adhesive and said side coat of adhesive.

7. The method of claim 6 wherein said step of attaching endsheets includes applying a thin strip of adhesive to a tip line of the pack, joining said end sheets to the tip line of the pack, and nipping the lower marginal portions of the pack.

8. A book binding system for binding a pack of signatures, at least some of said signatures including a plurality of interleaved sheets and each of said signatures having a closed side, said system comprising:

a clamping station for clamping the pack of signatures with said closed sides of said signatures lowermost and generally coplanar with one another along a spine of the pack;

a sawing station for sawing the spine of the pack to expose the interleaved sheets of the signatures;

a slashing station for slashing the spine of the pack with a multiplicity of cuts lateral to the length of the spine of the pack;

a preparatory adhesive applicator for applying a preparatory adhesive to the sawed spine of the pack to create an initial bond of the interleaved sheets of the signatures;

a first curing station for curing said preparatory adhesive until said preparatory adhesive is substantially free of surface moisture;

a notching station for forming a multiplicity of closely spaced, wide open notches in the spine of the pack after said first curing station cures said preparatory adhesive;

a spine coat applicator for applying a spine coat of adhesive to the spine of the pack after said notching station forms said notches;

a side coat applicator for applying a side coat of adhesive to lower marginal portions of opposing faces of the pack to close edges of said notches after said notching station forms said notches; and a second curing station for curing said spine coat of adhesive and said side coat of adhesive until said spine coat of adhesive and said side coat of adhesive are substantially set.

9. The system of claim 8 further including a brushing station for brushing off any loose particles from the spine of the pack after said notching station forms said notches.

10. The system of claim 8 wherein said spine coat of adhesive is a hot melt adhesive.

11. The system of claim 10 wherein said side coat of adhesive is a hot melt adhesive.

12. The system of claim 8 wherein said preparatory adhesive is an emulsion adhesive.

13. The system of claim 8 further including a endsheet attachment station for attaching endsheets to the pack after said second curing station cures said spine coat of adhesive and said side coat of adhesive.

14. A method of binding a pack of signatures, at least some of said signatures including a plurality of interleaved sheets and each of said signatures having a closed side, said method comprising the steps of:

clamping the pack of signatures with said closed sides of said signatures lowermost and generally coplanar with one another along a spine of the pack;

sawing and milling the spine of the pack to expose the interleaved sheets of the signatures;

slashing the spine of the pack with a multiplicity of cuts lateral to the length of the spine of the pack;

applying an emulsion adhesive to the sawed spine of the pack to create an initial bond of the interleaved sheets of the signatures;

drying said emulsion adhesive until said emulsion adhesive is substantially free of surface moisture;

after drying said emulsion adhesive, forming a multiplicity of closely spaced, wide open notches in the spine of the pack;

brushing off any loose particles from the spine of the pack;

after forming said notches, applying a spine coat of hot melt adhesive to the spine of the pack;

after forming said notches, applying a side coat of hot melt adhesive to lower marginal portions of opposing faces of the pack to close edges of said notches; and cooling said spine coat of adhesive and said side coat of adhesive until said spine coat of adhesive and said side coat of adhesive are substantially set; and after cooling said spine coat of adhesive and said side coat of adhesive, attaching endsheets to the pack.

* * * * *